US009970422B2

(12) United States Patent
Meacham et al.

(10) Patent No.: US 9,970,422 B2
(45) Date of Patent: May 15, 2018

(54) SELF-PUMPING STRUCTURES AND METHODS OF USING SELF-PUMPING STRUCTURES

(75) Inventors: John Mark Meacham, Atlanta, GA (US); Andrei G. Fedorov, Atlanta, GA (US); F. Levent Degertekin, Atlanta, GA (US)

(73) Assignee: Georgia Tech Research Corporation, Atlanta ( * ) Notice: Subject to any disclaimer, the term of this patent is extended or adjusted under 35 U.S.C. 154(b) by 2059 days.

(21) Appl. No.: 13/065,649

(22) Filed: Mar. 25, 2011

(65) Prior Publication Data

US 2011/0240752 A1 Oct. 6, 2011

Related U.S. Application Data

(60) Provisional application No. 61/319,072, filed on Mar. 30, 2010.

(51) Int. Cl.

| | |
|---|---|
| ***B05B 17/04*** | (2006.01) |
| ***F04B 19/00*** | (2006.01) |
| ***F04B 19/20*** | (2006.01) |

(52) U.S. Cl.

CPC ..... *F04B 19/006* (2013.01); *F04B 19/20* (2013.01)

(58) Field of Classification Search

CPC . B05B 17/0646; B05B 17/0607; B05B 17/06; F04B 19/006; F04B 19/20

USPC ..... 239/4, 102.1

See application file for complete search history.

(56) References Cited

U.S. PATENT DOCUMENTS

| | | | | |
|---|---|---|---|---|
| 6,802,460 | B2 * | 10/2004 | Hess | A61L 2/18 239/102.1 |
| 7,208,727 | B2 * | 4/2007 | Fedorov | B01L 3/0268 250/286 |
| 7,312,440 | B2 | 12/2007 | Degertekin et al. | |
| 7,367,661 | B2 * | 5/2008 | Hess | B05B 17/0638 239/102.1 |
| 7,411,182 | B2 | 8/2008 | Fedorov et al. | |
| 7,442,927 | B2 | 10/2008 | Fedorov | |
| 7,557,342 | B2 | 7/2009 | Fedorov et al. | |
| 7,595,487 | B2 | 9/2009 | Fedorov | |
| 7,669,428 | B2 | 3/2010 | Fedorov et al. | |
| 7,880,148 | B2 | 2/2011 | Fedorov et al. | |
| 7,909,897 | B2 | 3/2011 | Fedorov | |
| 2007/0243127 | A1 | 10/2007 | Federov | |
| 2008/0081900 | A1 | 4/2008 | Federov | |
| 2009/0040716 | A1 | 2/2009 | Federov | |
| 2009/0151923 | A1 | 6/2009 | Federov | |
| 2009/0272897 | A1 | 11/2009 | Federov et al. | |
| 2010/0001090 | A1 * | 1/2010 | Neergaard | B05B 17/0638 239/4 |
| 2010/0045752 | A1 * | 2/2010 | Xu | B64C 21/04 347/68 |

FOREIGN PATENT DOCUMENTS

| | | |
|---|---|---|
| EP | 1660018 | 5/2006 |
| WO | 05065072 | 7/2005 |
| WO | 2009029416 | 3/2009 |

* cited by examiner

*Primary Examiner* — Arthur O Hall
*Assistant Examiner* — Joel Zhou
(74) *Attorney, Agent, or Firm* — Thomas Horstemeyer, LLP

(57) ABSTRACT

Embodiments of the present disclosure provide for a self-pumping structure, methods of self-pumping, and the like.

27 Claims, 4 Drawing Sheets
(1 of 4 Drawing Sheet(s) Filed in Color)

SELF-PUMPING STRUCTURES AND METHODS OF USING SELF-PUMPING STRUCTURES

CROSS-REFERENCE TO RELATED APPLICATIONS

This application claims priority to U.S. Provisional Patent Application Ser. No. 61/319,072, entitled "Reservoir Configurations for Self-Pumping to Fill the Ejection Chamber of Electrostatic Cell Manipulation Device" filed on Mar. 30, 2010, which is hereby incorporated by reference.

BACKGROUND

Known devices that require movement of a fluid require complex pumping systems or depend on gravity to move a fluid. These pumping systems include an external pump that can malfunction and increases the cost of the device. Depending on gravity to move a fluid has limits on the volume of fluid that can be move and requires an excess of fluid to accomplish many goals. Alternatives to these types of pumps are needed to reduce the complexity and costs of devices that require movement of a fluid.

SUMMARY

Briefly described, embodiments of this disclosure, among others, include self-pumping structures, methods of self-pumping, and the like. One exemplary self-pumping structure, among others, includes: a fluid ejection system including: an actuator, an ejector device adapted to eject a fluid, and an inner reservoir, wherein the ejector device and the actuator are in fluidic communication with the inner reservoir, wherein inner reservoir is configured to contain the fluid that fills the inner reservoir and the ejector device; an outer reservoir in fluidic communication with the inner reservoir, wherein actuation of the actuator in the ejector device causes the fluid disposed in the outer reservoir to flow into the inner reservoir.

One exemplary method of filling fluid from an outer reservoir to an inner reservoir of a self-pumping structure, among others, includes: actuation of the actuator, and providing a pressure gradient along the inlet structure to cause the net flow of the fluid from the outer reservoir into the inner reservoir during actuation, wherein the fluid flows as a result of the actuation One exemplary method of ejecting a fluid from a structure, among others, includes: providing a fluid ejection system as described herein, actuation of the actuator, ejection of the fluid from the ejector device, and simultaneously flowing of the fluid from the outer reservoir into the inner reservoir during actuation, wherein the fluid flows as a result of the actuation.

Other apparatuses, systems, methods, features, and advantages of this disclosure will be or become apparent to one with skill in the art upon examination of the following drawings and detailed description. It is intended that all such additional apparatuses, systems, methods, features, and advantages be included within this description, be within the scope of this disclosure, and be protected by the accompanying claims.

BRIEF DESCRIPTION OF THE DRAWINGS

Further aspects of the present disclosure will be more readily appreciated upon review of the detailed description of its various embodiments, described below, when taken in conjunction with the accompanying drawings.

The patent or application file contains at least one drawing executed in color. Copies of this patent or patent application publication with color drawing(s) will be provided by the Office upon request and payment of the necessary fee.

DETAILED DESCRIPTION

Figure 1:
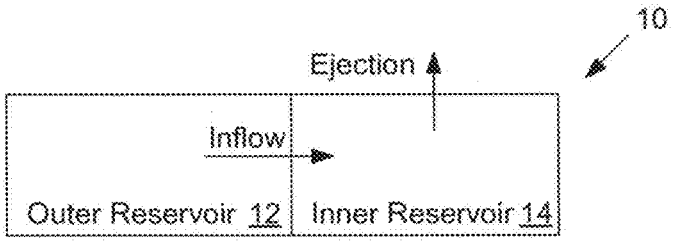
FIG. 1 is an illustration of an embodiment of a self-pumping structure of the present disclosure.

Before the present disclosure is described in greater detail, it is to be understood that this disclosure is not limited to particular embodiments described, and as such may, of course, vary. It is also to be understood that the terminology used herein is for the purpose of describing particular embodiments only, and is not intended to be limiting, since the scope of the present disclosure will be limited only by the appended claims.

Where a range of values is provided, it is understood that each intervening value, to the tenth of the unit of the lower limit unless the context clearly dictates otherwise, between the upper and lower limit of that range and any other stated or intervening value in that stated range, is encompassed within the disclosure. The upper and lower limits of these smaller ranges may independently be included in the smaller ranges and are also encompassed within the disclosure, subject to any specifically excluded limit in the stated range. Where the stated range includes one or both of the limits, ranges excluding either or both of those included limits are also included in the disclosure.

Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, the preferred methods and materials are now described.

All publications and patents cited in this specification are herein incorporated by reference as if each individual publication or patent were specifically and individually indicated to be incorporated by reference and are incorporated herein by reference to disclose and describe the methods and/or materials in connection with which the publications are cited. The citation of any publication is for its disclosure prior to the filing date and should not be construed as an admission that the present disclosure is not entitled to antedate such publication by virtue of prior disclosure. Further, the dates of publication provided could be different from the actual publication dates that may need to be independently confirmed.

As will be apparent to those of skill in the art upon reading this disclosure, each of the individual embodiments described and illustrated herein has discrete components and features which may be readily separated from or combined with the features of any of the other several embodiments without departing from the scope or spirit of the present disclosure. Any recited method can be carried out in the order of events recited or in any other order that is logically possible.

Embodiments of the present disclosure will employ, unless otherwise indicated, techniques of flow dynamics, mechanical engineering, material science, chemistry, and the like, which are within the skill of the art.

The following examples are put forth so as to provide those of ordinary skill in the art with a complete disclosure and description of how to perform the methods and use the structures disclosed and claimed herein. Efforts have been made to ensure accuracy with respect to numbers (e.g., amounts, temperature, etc.), but some errors and deviations should be accounted for. Unless indicated otherwise, parts are parts by weight, temperature is in ° C., and pressure is at or near atmospheric. Standard temperature and pressure are defined as 20° C. and 1 atmosphere.

Before the embodiments of the present disclosure are described in detail, it is to be understood that, unless otherwise indicated, the present disclosure is not limited to particular materials, reagents, reaction materials, manufacturing processes, or the like, as such can vary. It is also to be understood that the terminology used herein is for purposes of describing particular embodiments only, and is not intended to be limiting. It is also possible in the present disclosure that steps can be executed in different sequence where this is logically possible.

It must be noted that, as used in the specification and the appended claims, the singular forms "a," "an," and "the" include plural referents unless the context clearly dictates otherwise. Thus, for example, reference to "a compound" includes a plurality of compounds. In this specification and in the claims that follow, reference will be made to a number of terms, that shall be defined to have the following meanings unless a contrary intention is apparent.

Discussion

Embodiments of the present disclosure provide for self-pumping structures, methods of self-pumping, and the like. An advantage of an embodiment of the present disclosure is that external pumps and/or gravity feed fluid systems are not needed to flow a fluid from an outer reservoir into an inner reservoir, where the fluid is ejected from the self-pumping structure. As a result, the outer reservoir can be positioned or the self-pumping structure can be designed so that fluid does not flow under atmospheric pressure from the outer reservoir to the inner reservoir or the fluid can be prevented from flowing until acted upon by the self-pumping structure.

As shown in FIG. 1, an embodiment of the present disclosure provides for a self-pumping structure 10 that includes a fluid ejection system (not explicitly shown) and an outer reservoir 12. In an embodiment, the fluid ejection system includes an inner reservoir 14 bounded on at least two sides by an actuator and an ejector device (See FIGS. 2A and 2B). The inner reservoir 14 is in fluidic communication (the arrow) with the outer reservoir 12. When the actuator actuates, a fluid in the inner reservoir 14 is ejected through an orifice(s) in the ejector device out of the inner reservoir 14. The actuation also causes the fluid in the outer reservoir 12 to flow into the inner reservoir 14 at a flow rate so that the fluid can be ejected from the ejector device as long as there is fluid in the inner reservoir 14. In other words, the actuator, in part, controls the ejection of the fluid out of the inner reservoir 14 and the flow rate of the fluid into the inner reservoir 14. The actuation of the actuator in the self-pumping structure 10 allows the self-pumping structure to eject fluid from the ejector device without the need for an external pump and/or a gravity feed system. The actuation of the actuator causes the fluid to flow from the outer reservoir 12 into the inner reservoir 14. In other words, when fluid in the outer reservoir 12 does not flow into the inner reservoir 14 under the influence of gravity or otherwise is impeded from flowing (e.g., due to the design of the inlet structure), the action of the actuator and the design of the self-pumping structure 10 causes the fluid to flow from the outer reservoir 12 into the inner reservoir 14 (self-pumping structure) so that the fluid can be ejected from the ejector device. In an embodiment of the present disclosure the interface (e.g., inlet structure) between the inner reservoir 14 and the outer reservoir 12 can be designed so that fluid does not flow from the inner reservoir 14 to the outer reservoir 12 and/or from the outer reservoir 12 to the inner reservoir 14 unless the actuator is actuating under predetermined operating parameters (e.g., frequency, amplitude, waveform, and the like).

In an embodiment, the outer reservoir and the inner reservoir can be directly or indirectly in fluidic communication with one another. The outer reservoir and the inner reservoir can be in fluidic communication using one or more inlet structures. The inlet structure(s) can be connected to side, top, and/or bottom of the self-pumping structure at one or more locations (See FIGS. 2A to 3D). In an embodiment, the outer reservoir and the inner reservoir are in fluidic communication via one or more inlet structures in the actuator (See FIG. 2B). The term "fluidic communication" does not mean that that fluid flows, but that a fluid can flow under proper conditions (e.g., action of the actuator).

Figure 3A:
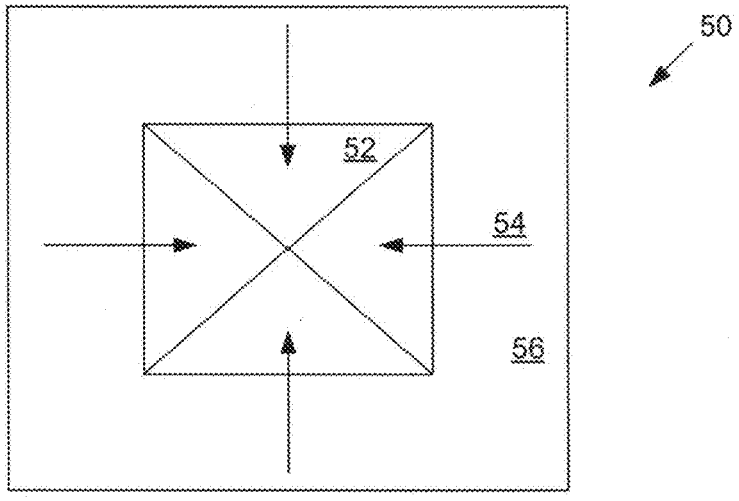
FIG. 3A illustrates a self-pumping structure that includes a single ejector device/inner reservoir.
Figure 3B:
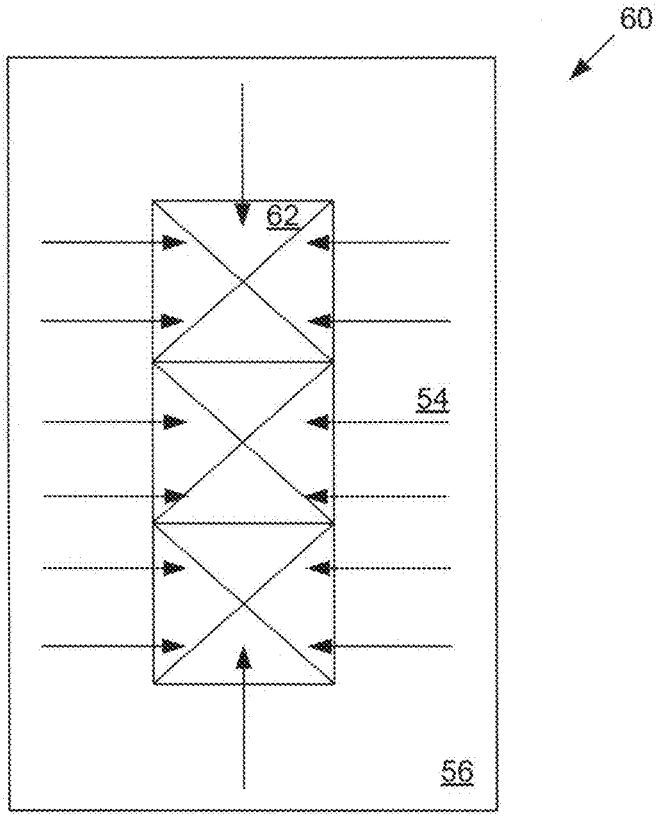
FIG. 3B illustrates a self-pumping structure that includes a three ejector device/inner reservoirs that are positioned in-line with one another.
Figure 3C:
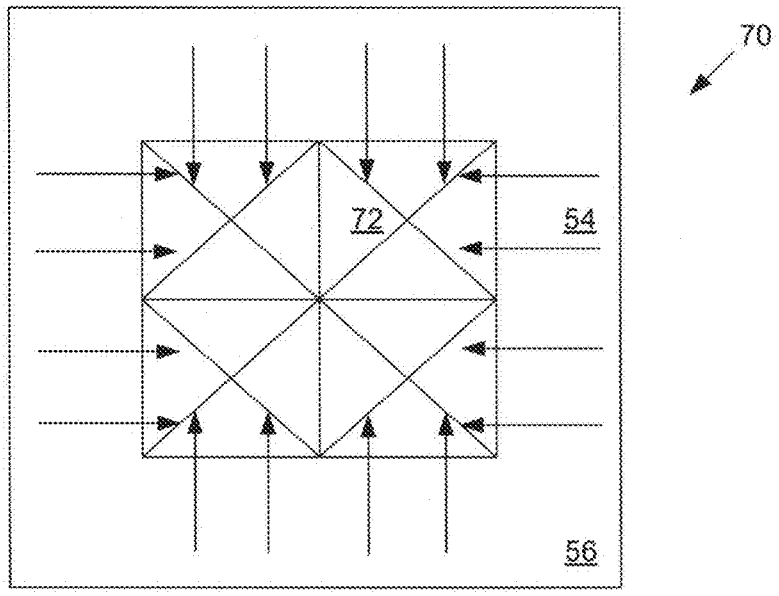
FIG. 3C illustrates a self-pumping structure that includes a four ejector device/inner reservoirs that are positioned in an array format.
Figure 3D:
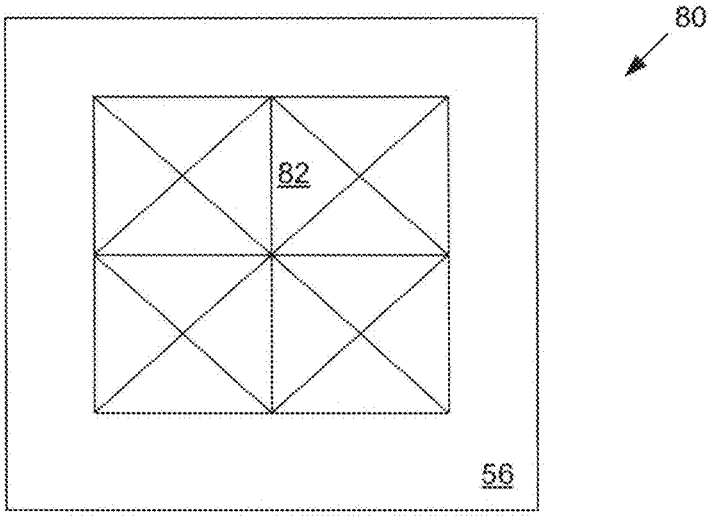
FIG. 3D illustrates a self-pumping structure that includes a four ejector device/inner reservoirs with an outer reservoir in communication with the inner reservoir via an open boundary.
Figures 4A, 4B, 4C, 4D, 4E, 4F, 4G:
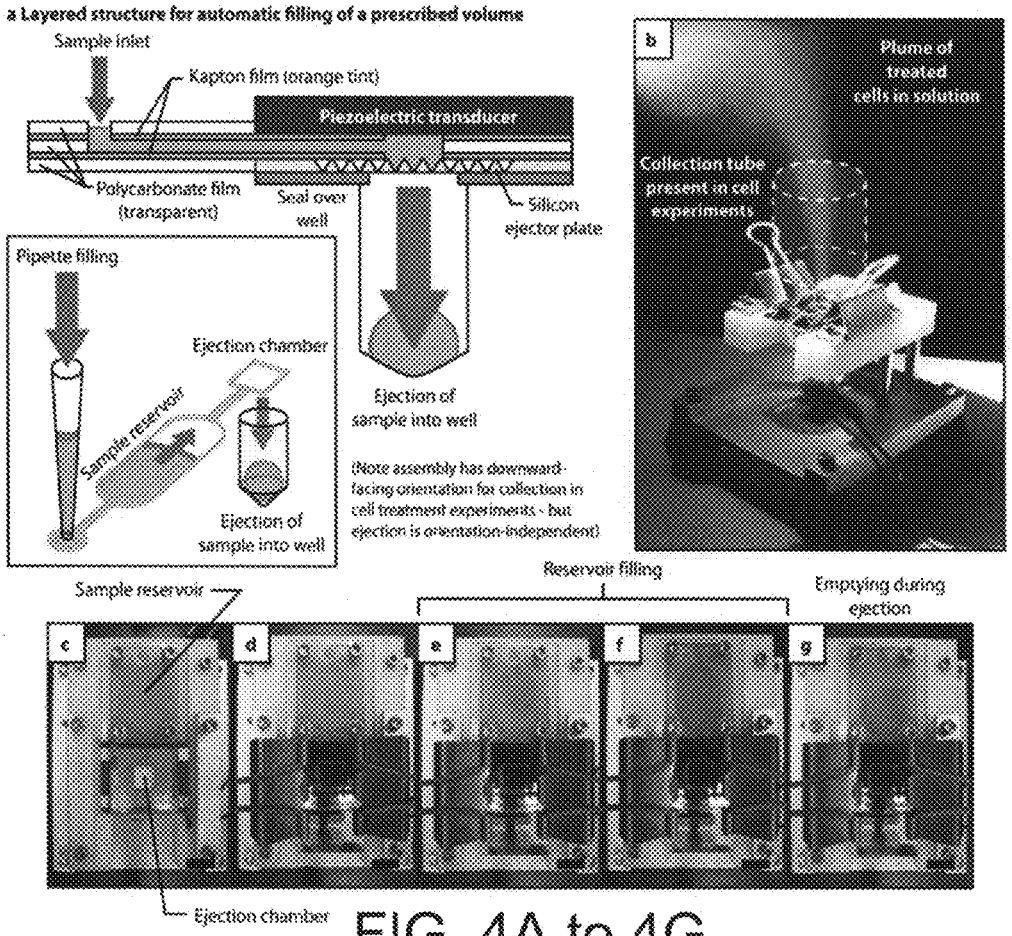
FIG. 4A is a cross-section of an embodiment of a single-channel self-pumping device.
FIG. 4B illustrates an embodiment of a prototype single-channel self-pumping device in operation.
FIG. 4C is a top-view layout of the fluidic layers in a prototype single-channel self-pumping device.
FIGS. 4D-G illustrate filling and ejection by self-pumping of a prototype single-channel self-pumping device.

Alternatively, the outer reservoir and the inner reservoir can be in communication via an open boundary or a substantially open boundary (See FIG. 3D). In other words, the outer reservoir and the inner reservoir are in direct communication and may only be separated by spacers separating one or more components of the self-pumping structure, and the inlet structures are not used to connect the outer reservoir to the inner reservoir. Additional details are provided below.

In an embodiment, one or more channels can open into the inner reservoir through one or more of the walls and/or through the actuator via one or more inlet structures. In an embodiment, the inlet structure can include a channel for fluid to flow from the outer reservoir to the inner reservoir. The channel or channels are designed so that the flow rate of the fluid from the outer reservoir into the inner reservoir is at a rate so that the fluid can be ejected from the ejector device. The dimensions (e.g., cross-section, length, height, width) of the channel are designed with consideration of the operation (e.g., frequency, amplitude, waveform, and the like) of the actuator, the fluid, and the design/shape of the ejector device so that the fluid flows from the outer reservoir into the inner reservoir and is ejected by the ejector device. As the actuator actuates, the fluid from the outer reservoir fills the inner reservoir at a certain rate, which may follow by ejection of the same amount of fluid using the ejector device. The inlet structure is designed so that the flow of the fluid into the inner reservoir can be maintained at a flow rate to eject fluid from the ejector device without unintentionally impeding the action of the actuator on the fluid and the ejection of the fluid from the ejector device. In an embodiment, the flow rate from the outer reservoir into the inner reservoir can be about 10 nanoliters/minute to 100 milliliters/minute or about 10 nl/min to 100 ml/min.

In an embodiment, the number of channels is equal on each side (sides being perpendicular to the actuator and ejector device) of the inner reservoir so that the inner reservoir can fill from each side in an equal manner (See FIG. 3A). In another embodiment, the number of channels can be selected based on the parameters such as flow rate, volume of the inner reservoir, volume of the outer reservoir, amount of fluid ejected as a function of the actuator action (e.g., frequency, amplitude, waveform, and the like), design and number of channels, and the like.

In an embodiment, the channel can have a circular, polygonal, elliptical, square, rectangle, or rhomboid, cross-section. The channel can have a length of about 10 μm to 10 cm, height of about 10 μm to 5 mm, and a width of about 10 μm to 10 cm. The channel can have a height and/or width that are constant along the length of the channel or can taper along the length of the channel or can have local constrictions. The channel can interface with the inner reservoir at the side near the top (close to the ejector nozzle) of the inner reservoir, middle of the reservoir, near the bottom of the reservoir (close to the actuator), and/or through the top of the ejection device and/or actuator.

Figure 2A:
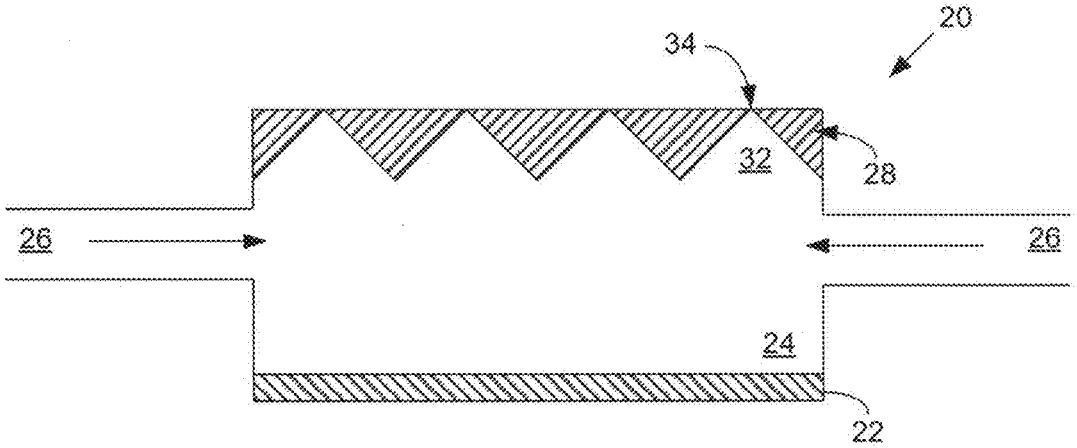
FIG. 2A illustrates a cross-section of an embodiment of the self-pumping structure.

FIG. 2A illustrates a cross-section of an embodiment of the self-pumping structure 20. The self-pumping structure 20 includes an actuator 22 and an ejection device 28 that form boundaries on two sides of the inner reservoir 24. Two channels 26 can flow fluid from the outer reservoir (not shown) to the inner reservoir 24 upon actuation of the actuator 22. The ejection device 28 includes the ejector structure 32 and the ejector orifice 34. The inner reservoir 24 includes the volume of the ejector structure 32.

Figure 2B:
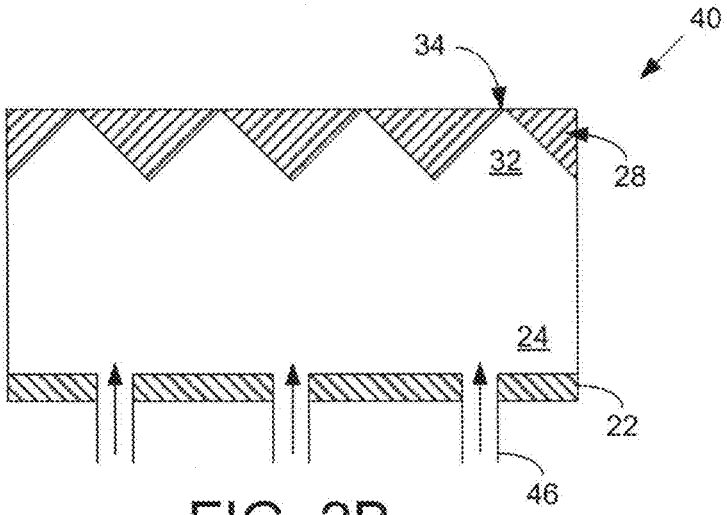
FIG. 2B illustrates a cross-section of an embodiment of the self-pumping structure that includes channels 46 through the actuator.

FIG. 2B illustrates a cross-section of an embodiment of the self-pumping structure 40 that includes channels 46 through the actuator 22. It should be noted that embodiments including more or less channels 46 can be designed and the design shown in FIG. 2A can be combined with the design in FIG. 2B.

FIGS. 3A to 3D illustrate a couple of different configurations of embodiments of self-pumping structures 50, 60, 70, and 80. FIG. 3A illustrates a self-pumping structure 50 that includes a single ejector device/inner reservoir 52. Four channels 54 (shown as arrows) can be used to flow fluid from the outer reservoir 56 into the inner reservoir 52. FIG. 3B illustrates a linear array of 3 self-pumping structures 60 that includes a three ejector devices/inner reservoirs 62 which can operate in sequence (filled from top or bottom) or in parallel (filled from the sides). Fourteen channels 54 (shown as arrows) can be used to flow fluid from the outer reservoir 56 into the inner reservoir 52. FIG. 3C illustrates a square array of self-pumping structures 70 that includes a four ejector devices/inner reservoirs 72. Sixteen channels 54 (shown as arrows) can be used to flow fluid from the outer reservoir 56 into the inner reservoir 72 with numerous permutations of sequential and/or parallel filling. FIG. 3D illustrates a self-pumping structure 80 that includes an open boundary (as represented by the use of no arrows) around a single ejector device/inner reservoir 82 so that the fluid in the outer reservoir 56, which can in principle be unbounded (e.g., a liquid pool on the surface), can flow into the inner reservoir 82.

The ejector device can include, but is not limited to, an ejector nozzle and an ejector structure. The inner reservoir includes the volume bounded by the ejector structure. The ejector device can be made of materials such as, but not limited to, single crystal silicon (e.g., oriented in the (100), (010), or (001) direction), metals (e.g., aluminum, copper, and/or brass), plastics, silicon oxide, silicone nitride, and combinations thereof.

The ejector structure can have a shape such as, but not limited to, conical, pyramidal, or horn-shaped with different cross-sections. In general, the cross-sectional area is decreasing (e.g., linear, exponential, or some other functional form) from a base of the ejector nozzle (broadest point adjacent the reservoir) to the ejector nozzle in both two and three dimensions. The cross sections can include, but are not limited to, a triangular cross-section, and exponentially narrowing. In an embodiment, the ejector structure is a pyramidal shape. In an embodiment, the ejector nozzle can be a two dimensional groove or have a three-dimensional tapered geometry. In another embodiment, geometry of the nozzle cavity is not tapered, but is terminated by the opening/channel which is of substantially smaller diameter that the cavity.

In one embodiment, the ejector structure has acoustic wave focusing properties in order to establish a highly-localized, pressure maximum substantially close to the ejector nozzle. This results in a large pressure gradient at the ejector nozzle since there is effectively an acoustic pressure release surface at the ejector nozzle. Since the acoustic velocity is related to the pressure gradient through Euler's relation, a significant momentum is transferred to the fluid volume close to the ejector nozzle during each cycle of the acoustic wave in the ejector structure. When the energy coupled by the acoustic wave in the fluid volume is substantially larger than the restoring energy due to surface tension, viscous friction, and other sources, the fluid surface is raised from its equilibrium position. Furthermore, the frequency of the waves can be such that there is enough time for the droplet to break away from the surface due to instabilities. Alternatively, the frequency of the waves can be such that the ejection is a jet ejection of the fluid.

The ejector structure has a diameter (at the base of a single nozzle) of about 50 micrometers to 5 millimeters, 300 micrometers to 1 millimeter, and 600 micrometers to 900 micrometers. The distance (height) from the ejector nozzle aperture (opening) to the broadest point in the ejector structure (base of the nozzle) is from about 20 micrometers to 4 millimeters, 200 micrometers to 1 millimeter, and 400 micrometers to 600 micrometers.

The ejector nozzle aperture size and shape effectively determine the droplet/jet size and the amount of pressure focusing along with the ejector structure geometry (i.e., cavity geometry). The ejector nozzle can be formed using various manufacturing techniques as described below and can have a shape such as, but not limited to, circular, polygonal, elliptical, square, rectangle, or rhomboid. The ejector nozzle aperture has a diameter of about 50 nanometers to 200 micrometers, 200 nanometers to 100 micrometers, and 1 micrometer to 10 micrometers.

The ejector device can include one ejector nozzle, an (one-dimensional) array of ejector nozzles, or a (two dimensional) matrix of parallel arrays of ejector nozzles. The ejector structure can include one ejector nozzle each or include a plurality of ejector nozzles in a single ejector structure.

The inner reservoir is substantially defined by the ejector device and the actuator. The other boundaries can be walls or separation layers to contain the fluid in the inner reservoir. In an embodiment, one or more inlet structures can open into the inner reservoir. The inner reservoir is an open area connected to the open area of the ejector structures so that fluid is in both areas. As noted above, the inner reservoir is in fluidic communication with the outer reservoir.

In general, the dimensions of the inner reservoir and the ejector structure can be selected to excite a cavity resonance in the structure at a desired frequency. The structures may have cavity resonances of about 20 kHz to 100 MHz, depending, in part, on fluid type and dimensions and cavity shape, when excited by the actuator.

The dimensions of the inner reservoir are about 100 micrometers to 4 centimeters in width, about 100 micrometers to 4 centimeters in length, and about 100 nanometers to 5 centimeters in height. In addition, the dimensions of the reservoir are about 100 micrometers to 2 centimeters in width, about 100 micrometers to 2 centimeters in length, and about 1 micrometer to 3 millimeters in height. Further, the dimensions of the reservoir are about 100 micrometers to 1 centimeter in width, about 100 micrometers to 1 centimeter in length, and about 100 micrometers to 2 millimeters in height.

The actuator produces a resonant ultrasonic wave within the inner reservoir and fluid. As mentioned above, the resonant ultrasonic wave couples to and transmits through the liquid and is focused by the ejector structures to form a pressure gradient within the ejector structure. If the nozzles are open for ejection, the high-pressure gradient accelerates fluid out of the ejector structure to produce ejection. Ejection can produce discrete droplets in a drop-on-demand manner or a continuous jet. The frequency at which the droplets are formed is a function of the drive cycle applied to the actuator as well as the fluid, reservoir, ejector structure, and the ejector nozzle. In addition to ejecting the fluid, the actuation causes the fluid to flow from the outer reservoir into the inner reservoir. In other embodiments with flow-through configurations, the nozzle may be closed and the fluid experiences time varying mechanical agitation within the nozzle cavities as it is being pumped through the inner reservoir and the nozzle structure without being ejected from the device.

Different actuators could be used to drive the self-pumping device and also to produce fluid ejection, including the piezoelectric and capacitive type (e.g., CMUT). An alternating voltage is applied to the actuator to cause the actuator to produce the resonant ultrasonic wave. The actuator can operate at about 20 kHz to 100 MHz, about 500 kHz to 15 MHz, and about 800 kHz to 5 MHz. A direct current (DC) bias voltage can also be applied to the actuator in addition to the alternating voltage. In embodiments where the actuator is piezoelectric, this bias voltage can be used to prevent depolarization of the actuator and also to generate an optimum ambient pressure in the reservoir. In embodiments where the actuator is electrostatic, the bias voltage is needed for efficient and linear operation of the actuator. Operation of the actuator is optimized within these frequency ranges in order to match the cavity resonances, and depends on the dimensions of and the materials used for fabrication of the inner reservoir and the ejector device as well the acoustic properties of the fluids inside the ejector.

The actuator can include, but is not limited to, a piezoelectric actuator and a capacitive actuator. The piezoelectric actuator and the capacitive actuator are described in X. C. Jin, I. Ladabaum, F. L. Degertekin, S. Calmes and B. T. Khuri-Yakub, "Fabrication and Characterization of Surface Micromachined Capacitive Ultrasonic Immersion Transducers", IEEE/ASME Journal of Microelectromechanical Systems, 8, pp. 100-114, 1999 and Meacham, J. M., Ejimofor, C., Kumar, S., Degertekin F. L., and Fedorov, A., "A Micromachined Ultrasonic Droplet Generator Based on Liquid Horn Structure", *Rev. Sci. Instrum.,* 75 (5), 1347-1352 (2004), which are incorporated herein by reference.

One particular embodiment that enables low power input ejection of the fluid is resonant, ultrasonically driven atomization which operates by providing an AC electrical signal to the actuator (piezoelectric transducer) with a frequency equal to the resonance of the fluid filled cavity (inner reservoir and set of ejector structures). The resonant acoustic wave in the fluid in the inner reservoir is focused by the ejector structure (e.g., pyramidal nozzles), creating a high pressure gradient at the ejector structure nozzle aperture, and thus ejecting the fluid that fills the nozzle cavity. Since the ejector structures can be fabricated using micromachining techniques the orifice size is well controlled, resulting in monodisperse droplet ejection for precise flow rate control. Additional details regarding ultrasonically driven atomization are described in publications (Meacham, J. M., Ejimofor, C., Kumar, S., Degertekin F. L., and Fedorov, A., 2004, "A Micromachined Ultrasonic Droplet Generator Based on Liquid Horn Structure", *Review of Scientific Instruments*, Vol. 75, No. 5, pp. 1347-1352; Meacham, J. M., Varady, M., Degertekin F. L., and Fedorov, A., 2005, "Droplet Formation and Ejection from a Micromachined Ultrasonic Droplet Generator: Visualization and Scaling", *Physics of Fluids*, Vol. 17, No. 10, pp. 100605-100613; Meacham, J. M., Varady, M., Esposito, D., Degertekin, F. L., and Fedorov, A., "A Micromachined Ultrasonic Atomizer For Liquid Fuels", *Atomization and Sprays,* 18, pp. 163-190 (2008)), each of which is incorporated herein by reference.

A drop-on-demand ejection can be achieved by modulation of the actuation signal in the time domain. The actuator generating ultrasonic waves can be excited by a finite duration signal with a number of sinusoidal cycles (a tone burst) at the desired frequency. Once a certain energy level is reached for droplet ejection, during the initial cycles of this signal, the standing acoustic wave pattern in the resonant cavity is established and the energy level is brought up to the ejection threshold. The number of cycles required to achieve the threshold depends on the amplitude of the signal input to the wave generation device and the quality factor of the cavity resonance. After the threshold is reached, one or more droplets can be ejected in a controlled manner by reducing the input signal amplitude after the desired number of cycles. This signal can be used repetitively, to eject a large number of droplets. Another useful feature of this operation is to reduce the thermal effects of the ejection, since the device can cool off when the actuator is turned off between consecutive ejections. The ejection speed can also be controlled by the amplitude and duration of the input signal applied to the actuator.

The dimensions of the actuator depend on the type of actuator used. For embodiments where the actuator is a piezoelectric actuator, the thickness of the actuator is determined, at least in part, by the frequency of operation and the type of the piezoelectric material. The thickness of the piezoelectric actuator is chosen such that the thickness of the actuator is about half the wavelength of longitudinal waves in the piezoelectric material at the frequency of operation. Therefore, in case of a piezoelectric actuator, the dimensions of the actuator are about 100 micrometers to 10 centimeters in width, about 10 micrometers to 1 centimeter in thickness, and about 100 micrometers to 10 centimeters in length. In addition, the dimensions of the actuator 42 are about 100 micrometers to 2 centimeters in width, about 10 micrometers to 5 millimeters in thickness, and about 100 micrometers to 2 centimeters in length. Further, the dimensions of the actuator 42 are about 100 micrometers to 1 centimeter in width, about 10 micrometers to 2 millimeters in thickness, and about 100 micrometers to 1 centimeter in length.

In embodiments where the actuator is a capacitive actuator, the actuator is built on a wafer made of silicon, glass, quartz, or other substrates suitable for microfabrication, where these substrates determine the overall thickness of the actuator. Therefore, in case of a capacitive microfabricated ultrasonic transducer (CMUT) and CMUT arrays, the dimensions of the actuator are about 10 micrometers to 4 centimeters in width, about 10 micrometers to 2 millimeter in thickness, and about 10 micrometers to 4 centimeters in length. In addition, the dimensions of the actuator are about 100 micrometers to 2 centimeters in width, about 10 micrometers to 1 millimeter in thickness, and about 100 micrometers to 2 centimeters in length. Further, the dimensions of the actuator are about 100 micrometers to 1 centimeter in width, about 10 micrometers to 600 micrometers in thickness, and about 100 micrometers to 1 centimeter in length.

The fluid can include a liquid such as, but not limited to, water, methanol, dielectric fluorocarbon fluid, organic solvent, or other liquids, and combinations thereof.

Having described embodiments of the present disclosure generally thus far, the following paragraphs describe embodiments of the present disclosure in additional details. Upon actuation of the actuator, a resonant ultrasonic wave can be produced within the inner reservoir and the fluid. The resonant ultrasonic wave couples to and transmits through the fluid and is focused by the ejector structures to form a pressure gradient within the ejector structure. The high-pressure gradient forces fluid out of the ejector nozzle producing droplets. The frequency of the drive signal applied to the actuator dictates, at least in part, the rate at which the droplets are discretely produced and the flow of the fluid from the outer reservoir into the inner reservoir. The droplets are produced either discretely (e.g., drop-on-demand), as a continuous jet of droplets, or in bursts of droplets, where the production is determined by the actuation of the actuator, while the flow of the fluid from the outer reservoir into the inner reservoir flows at a rate so that the fluid exiting the inner reservoir is equal to the flow into the reservoir, where the rate is determined at least in part by the actuation of the actuator.

The ejector nozzle exit orifice diameter, the array structure, and geometry, nozzle count, and the frequency of operation, have a direct impact on the volumetric outflow that is balanced by the inflow of fluid from the outer reservoir into the inner reservoir, where the operation of the actuator can be selected to adjust the operation of the self-pumping structure. The ejection outflow rate $Q_o$ from a single ejector nozzle is equal to the operating frequency $f_o$ of a waveform driving the actuator (at resonance) multiplied by the volume Vol of a droplet exiting the nozzle orifice of that ejector nozzle, i.e., $Q_o=f_o\cdot Vol$. The volume of a droplet is approximated as the volume of a sphere, the diameter of which is equal to the diameter $d_o$ of the ejector nozzle exit orifice, i.e., $Vol=\pi\cdot d_o^3/6$. Therefore, for an array of n nozzles driven by a single actuator, the overall outflow rate for the device is $Q_o=n\cdot f_o\cdot\pi\cdot d_o^3/6$, i.e., the volumetric outflow rate is directly dependent on the number of nozzles in an array structure and the frequency of operation, and also dependent on the ejector nozzle orifice diameter to the third power. For example, an array of 100 nozzles, driven at a frequency of 1 MHz, with 50 micrometer diameter orifices, yields an overall volumetric outflow rate equal to $Q_o=(100)\cdot(1000000\ s^{-1})\cdot 3.1416\ (0.000050\ m)^3/6=\cdot 6\times 10^{-6}\ m^3/s$ or 6 ml/s. In addition, the overall outflow rate of the device can be modulated up or down by, manipulating the ejection process in time (via burst mode operation) or space (via active nozzle manipulation) to increase or decrease the outflow from the ejector nozzle orifices. The outflow of the fluid from the inner reservoir is matched by the inflow of the fluid from the outer reservoir so that the self-pumping structure can operate in a drop on demand mode, a continuous droplet (or jet) mode or a burst mode.

During continuous device operation, an unbroken periodic (e.g., sinusoidal) waveform is used to drive the actuator. The device can also be driven in a burst mode, whereby the sinusoidal signal is broken into 'packets' of waveforms generated at a regular frequency corresponding to a burst period that is longer than the ejection period. During the 'active' ('on') portion of the burst period, the device operates as if under continuous flow mode, and during the remainder of the burst period ('inactive' or 'off' portion) between waveform packets, ejection is turned off. For example, the operating frequency $f_o$ is 1 MHz corresponding to an ejection period $P_o$ of 1 μs. If a packet of m=100 cycles of the drive waveform is sent to the actuator at a burst period $P_b$ of 1 ms, the signal is 'on' for $t_{on}=m\cdot P_o=100\cdot 0.000001$ s=0.1 ms. Therefore the duty cycle of the piezoelectric transducer is $t_{on}/P_b=(0.1\ ms)/(1\ ms)=0.10$ or the actuator is driven only 10% of the time. The duty cycle is dictated by the drive waveform and can be any percentage from 0 to 100%. The overall volumetric outflow rate of the device can be manipulated up or down by setting the duty cycle. The outflow of the fluid from the inner reservoir is matched by the inflow of the fluid from the outer reservoir.

By adjusting the operating frequency up or down around a particular resonant frequency of the inner reservoir the pressure field uniformity of the ultrasonic wave within the inner reservoir is altered; this technique can be used to deactivate a fraction of the ejector nozzles in the array structure during operation (either in continuous mode or during the 'on' portion of burst mode operation). Typically the 'active' nozzle count can be modulated to from about 10 and 90%.

In regard to the inlet structures, the inlet structure (also can be referred to as the "interface") between an outer reservoir and the inner reservoir supplies enough fluid inflow to sustain operation of the self-pumping structure; otherwise, it may operate only sporadically or not at all. Over very short time periods (on the order of the inverse of the operating frequency), the outflow of the fluid from the ejector nozzles is transient, i.e., there is an inflow and outflow of fluid at each ejector nozzle orifice over a single ejection period, with the net result being positive ejection of fluid in the form of a droplet. The inner reservoir volume is large in comparison with the volume of a single droplet, and so the oscillatory action of the ultrasonic wave at the ejector nozzle orifices can be averaged over time to determine a steady outflow rate as shown above under continuous mode. In addition, it is assumed that the inner reservoir is rigid, that there are no air bubbles, and that the displacement of the actuator is small; therefore, the inner reservoir volume does not change with time, and the inflow rate of the fluid must be equal to the outflow rate over tens to hundreds of ejection periods.

The requirement that the inflow rate must balance outflow at the steady-state operation (i.e., this is not necessary during the initial filling or a final discharge of the inner reservoir) places restrictions on the design of the inlet structure because there are finite limits on the magnitude of the pressure drop that can be overcome to introduce the fluid in the inner reservoir for self-pumping. If a gravity feed or a pressurized external reservoir is used, a higher pressure drop can be overcome at the expense of additional design complexity. In practical terms, the inlet structure is designed to minimize the flow resistance of fluid into the inner reservoir. Inlet structures as shown in FIG. 3A to 3D can be categorized as including one or more inlet channels connecting the outer reservoir to the inner reservoir or an open boundary where the outer reservoir is placed in direct communication with the inner reservoir along one or more shared borders.

The inlet channel architecture includes one or more fluid flow paths of defined cross sectional area and length that supply fluid to the inner reservoir. These inlet channels can be in the same plane as the inner reservoir (i.e., with inflow at the side edges of the inner reservoir perpendicular to the direction of ejection outflow) and/or located through the actuator (e.g., drilled or machined through a piezoelectric transducer in parallel to the direction of ejection outflow), and can be a shape such as, but not limited to, circular, polygonal, elliptical, square, rectangle, or rhomboid cross-section.

If the inlet structure includes a single channel, the pressure drop that must be overcome by the fluid flowing into the inner reservoir is a function of the structure of the inlet channel geometry and the flow rate, $\Delta P=f(R,Q_i)$, where R is a flow resistance dependent on the length/and lateral channel dimensions, represented by d, of the inlet channel. In addition, the inlet channel internal cross-section can be shaped along the flow direction such that the hydraulic resistance for fluid pumping is different for opposing directions of the fluid flow, thus forming a fluidic diode and providing a preferred directionality for the fluid transport (e.g., from the outer reservoir into the inner reservoir). If the flow is laminar, which is common for microchannel flow due to the typically small dimensions, the dependence on flow rate is linear, i.e., $\Delta P=R\cdot Q_i$. If the flow is turbulent (e.g., the Reynolds number $Re=\rho\cdot V\cdot d/\mu>2300$—where $\rho$ and $\mu$ are the density and viscosity of the fluid, and V is the inlet velocity—for internal flow in a circular pipe), then this dependence becomes $\Delta P=R\cdot Q_i^2$. This transition can occur if the velocity V or characteristic channel dimension d is increased significantly.

Although the exact form of the flow resistance is dependent upon the inlet channel shape (e.g., circular, rectangular, elliptical, etc.), it generally increases with length and decreases with lateral channel dimension. For example the flow resistance of a circular channel is $R=8\cdot\mu\cdot l/(\pi\cdot r_o^4)$ where $r_o$ is the radius of the inlet channel; for a rectangular channel, $R=3\cdot\mu\cdot l/(4\cdot b\cdot a^3)\cdot f(b,a)$ where a and b are the half height and width of the inlet channel, respectively, and f(b,a) is a function of these variables.

As stated above, the inlet flow rate $Q_i$ is dictated by the required volumetric outflow $Q_o$ so the resistance to flow (pressure drop) can be controlled by shortening the inlet channel or increasing the width and height of the inlet channel, or the actuator can be driven at a larger magnitude to overcome the pressure drop requirement. Another possibility is to create an inlet structure with multiple inlet channels in parallel effectively increasing the cross-sectional area of the inlet. This decreases the inlet flow rate and velocity, which favors laminar flow.

Taking the inlet channel architecture to its ultimate limit, the edges of the inner reservoir can be used as the inlet forming an open boundary architecture. The interface has no defined length as the outer reservoir and inner reservoir share one or more borders. The most basic open boundary configuration is an inner reservoir surrounded by an outer reservoir. Other open boundary configurations include a line of ejector structures or a square array with an outer reservoir along the entire array boundary. The primary benefit of the open boundary architecture is a minimization of the flow resistance (and therefore the pressure drop that must be overcome by the fluid entering the inner reservoir) as there is no actual inlet channel present between the inner reservoir and the outer reservoir.

The inflow area (and therefore the flow resistance) can span many orders of magnitude. Typically, the maximum lateral extent of a single inflow 'channel' (representing an open boundary) is equal to the perimeter of the inner reservoir. For a 20×20 nozzle array structure, this is equal to about 60 mm (about 0.75 mm per nozzle, 20 nozzles per side, and 4 sides of the array), and for a single ejector nozzle structure, this is equal to about 3 mm. The smallest inflow area would correspond to an infinitely small (in height and width) inlet channel; however, in practice, the smallest width of a single channel is about 1 mm. The height of the inflow channel can vary from about 50 micrometers to the height of the reservoir between the actuator and the ejector device, which is typically 1-3 mm. Using the upper and lower limits describe for the dimension for the inner reservoir, the inflow cross-sectional area would vary from 5e-8 $m^2$ to 2e-4 $m^2$.

Self-pumping driven by the actuator, which also drives droplet ejection, obviates the need for an external pump or gravity feed. If an outer reservoir is placed 'around' or in fluid communication with the inner reservoir, the device can naturally pull fluid into the inner reservoir during operation if the actuator action is able to maintain an inflow rate that balances outflow due to the ejection process. This requirement places restrictions on the design of inlet structures, specific embodiments of which are described herein. Further, if the outer reservoir contains a precisely defined volume of fluid (for example loaded manually or automatically in a controlled manner via pipette), the device will eject only that prescribed amount of fluid for collection. This non-obvious device improvement is well-suited to multi-sample biological assays where different samples are treated and collected in parallel. This improves compatibility with existing equipment and greatly simplifies interfacing with other high-throughput and parallel techniques.

While embodiments of the present disclosure are described in connection with the Examples and the corresponding text and figures, there is no intent to limit the disclosure to the embodiments in these descriptions. On the contrary, the intent is to cover all alternatives, modifications, and equivalents included within the spirit and scope of embodiments of the present disclosure.

Example:

An embodiment of a self-pumping structure using a single channel interface is shown in FIGS. 4A-G. The sample reservoir, inner reservoir, and fluidic channel were cut out of 520 micrometer thick polycarbonate (PC) film using a laser.

Two layers of 50 micrometer thick Kapton polyamide film were placed above and below the PC to form a sandwich structure around the reservoir. PC films also enhance the structural rigidity of the overall assembly. The polymer fluidic layers were fixed between the piezoelectric transducer and an ejector device (see FIG. 4B, 4D-G). PC and polyamide films were used because they are transparent to facilitate visualization of filling (and emptying). Green dye was added to deionized water to help visualize chamber filling and emptying as shown in FIG. 4D-G. Steady ejection occurred at a constant rate during piezoelectric actuation at an operating frequency of 970 kHz and power input of about 2 Watts. The piezoelectric transducer was driven in a burst mode at 10% duty cycle. The nozzle array had 25 apertures, and the aperture size was about 50 micrometers. No liquid remained in the external reservoir indicating that the chamber size can be used to prescribe the ejected volume of fluid. The dead volume is equal to the volume of the ejection chamber (as small as 100 nl).

Figures 5A, 5B, 5C:
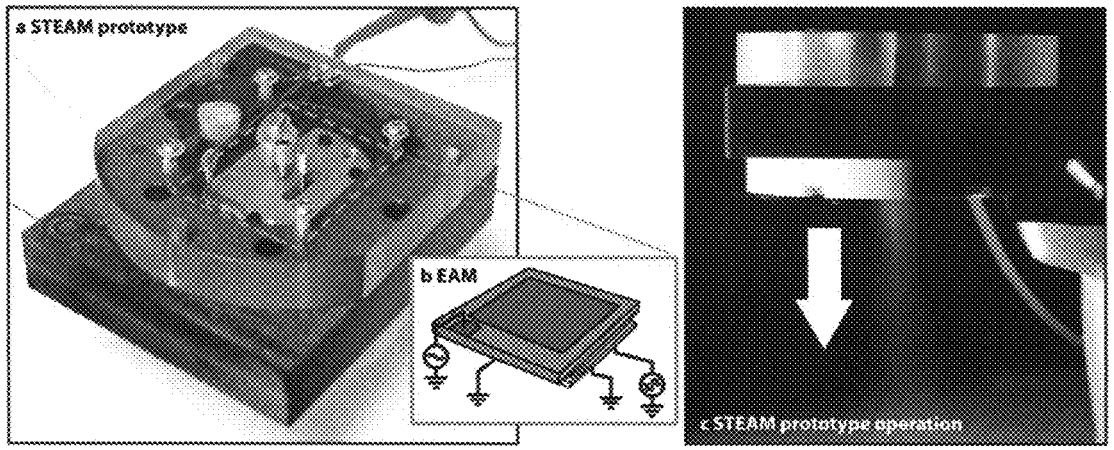
FIG. 5A shows an assembled open-boundary prototype.
FIG. 5B is an illustration of the ejection device and actuator, which are placed into the housing of the open-boundary prototype. The housing contains both the external and internal reservoir.
FIG. 5C illustrates ejection from the open-boundary prototype.

An embodiment of self-pumping using an open boundary between an external and internal reservoir has also been demonstrated. FIGS. 5A to C show ejection from a 16 by 16 array of 50 micrometer apertures under similar conditions as shown in FIGS. 4A to G. In the prototype shown in FIGS. 5A to C, however, the ejection device and actuator are separated by a spacer that is substantially open (an open boundary) to promote low flow resistance between the external and internal reservoirs. The ejection device and actuator are shown inside the housing containing both the external and internal reservoirs in FIG. 5A. Successful operation of the device shown in FIG. 5C indicates a higher sustained flow rate in FIG. 5 (open boundary) than in FIG. 4 (single inlet channel). Typical flow rates are in the range of about 1 to 2 milliliters per minute under burst mode operation at 10% duty cycle.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. In an embodiment, the term "about" can include traditional rounding according to significant figures of the numerical value. In addition, the phrase "about 'x' to 'y'" includes "about 'x' to about 'y'".

It should be emphasized that the above-described embodiments of the present disclosure are merely possible examples of implementations, and are set forth only for a clear understanding of the principles of the disclosure. Many variations and modifications may be made to the above-described embodiments of the disclosure without departing substantially from the spirit and principles of the disclosure. All such modifications and variations are intended to be included herein within the scope of this disclosure.

What is claimed is:

1. A self-pumping structure comprising:

a fluid ejection system including:

an actuator, an ejector device adapted to eject a fluid, wherein the ejector device includes one or more pairs of an ejector nozzle and an ejector structure, wherein the ejector nozzle is at the end of the ejector structure, wherein fluid is ejected out of the ejector nozzle through an open aperture, wherein the ejector structure has a cross-section selected from the group consisting of: a conical cross-section, a pyramidal cross-section, and a horn-shaped cross-section, and each cross-section has a dimensional configuration in two dimensions or in three dimension, and an inner reservoir, wherein the ejector device and the actuator are in fluidic communication with the inner reservoir, wherein inner reservoir is configured to contain the fluid that fills the inner reservoir and the ejector device;

an outer reservoir in fluidic communication with the inner reservoir, wherein actuation of the actuator in the ejector device causes the fluid disposed in the outer reservoir to flow into the inner reservoir.

2. The structure of claim 1, wherein the fluid filling the inner reservoir is being ejected from the ejector device.

3. The structure of claim 1, wherein the outer reservoir and the inner reservoir are in fluidic communication via one or more inlet structures.

4. The structure of claim 3, wherein the inlet structure is selected from a channel.

5. The structure of claim 3, wherein the channel has low resistance to the fluid flow.

6. The structure of claim 1, wherein the outer reservoir and the inner reservoir are in fluidic communication via a substantially open boundary.

7. The structure of claim 1, wherein the actuator is selected from the group consisting of piezoelectric actuator and the capacitive actuator.

8. The structure of claim 1, wherein the ejector device includes an array of pairs selected from the group consisting of a one-dimensional array and a two dimensional array of the ejector nozzle and the ejector structure.

9. The structure of claim 1, wherein the ejector structure has a diameter at the base of about 50 micrometers to 5 millimeters and the ejector structure has a height from the ejector nozzle aperture to the broadest point in the ejector structure of about 20 micrometers to 4 millimeters, wherein the ejector nozzle has a diameter of about 50 nanometers to 50 micrometers, and wherein the dimensions of the inner reservoir are about 100 micrometers to 10 centimeters in width, about 100 micrometers to 10 centimeters in length, and about 100 nanometers to 5 centimeters in height.

10. The structure of claim 3, wherein the inlet structure has a cross-section selected from: circular cross-section, polygonal cross-section, elliptical cross-section, square cross-section, rectangular cross-section, and rhombus cross-section.

11. The structure of claim 3, wherein the inlet structure has a length of about 10 micrometers to 10 cm, a height of about 100 nanometers to 1 cm, and a width of about 100 nanometers to 1 cm.

12. The structure of claim 3, wherein the inlet structure is tapered from the outer reservoir to the inner reservoir.

13. The structure of claim 1, wherein the outer reservoir and the inner reservoir are in fluidic communication via an inlet structure in the actuator.

14. The structure of claim 3, comprising a plurality of inlet structures, wherein the inlet structures are operated in a sequence with one another or in parallel with one another.

15. The structure of claim 14, wherein the inlet structures are each operated independently of one another.

16. The structure of claim 1, wherein the fluid in the outer reservoir does not flow into the inner reservoir unless the actuator is actuated.

17. The structure of claim 3, wherein the inlet structures are designed to restrict flow of the fluid from the outer reservoir into the inner reservoir unless the actuator is actuated.

18. A method of filling fluid from the outer reservoir to the inner reservoir, comprising:

providing a fluid ejection system of claim 1, actuation of the actuator, and providing a pressure gradient along the inlet structure to cause the net flow of the fluid from the outer reservoir into the inner reservoir during actuation, wherein the fluid flows as a result of the actuation.

19. A method of ejecting a fluid from a structure, comprising:

providing a fluid ejection system of claim 1, actuation of the actuator, ejection of the fluid from the ejector device, and simultaneously flowing of the fluid from the outer reservoir into the inner reservoir during actuation, wherein the fluid flows as a result of the actuation.

20. The method of claim 19, wherein the fluid flows through one or more inlet structures connecting the outer reservoir and the inner reservoir.

21. The method of claim 19, wherein the fluid flows through one or more inlet structures in the actuator, wherein the inlet structure connects the outer reservoir and the inner reservoir.

22. The method of claim 19, wherein the fluid flows through a substantially open boundary between the outer reservoir and the inner reservoir.

23. The method of claim 19, wherein the actuator operates at an ultrasonic frequency to continuously eject the fluid.

24. The method of claim 19, wherein the actuator is driven by a periodic waveform that is broken into packets of waveforms to eject the fluid in a burst pattern.

25. The method of claim 19, wherein the actuator operates at a frequency that is different than a resonant frequency of the ejector structure to alter the pressure field generated in one or more ejector structures of the ejector device, wherein the alteration of the pressure field deactivates one or more of the ejectors structures so the deactivated ejector structure does not eject the fluid.

26. The method of claim 19, wherein the fluid in the outer reservoir does not flow into the inner reservoir unless the actuator is actuated.

27. The method of claim 20, wherein the inlet structures are designed to restrict flow of the fluid from the outer reservoir into the inner reservoir unless the actuator is actuated.

* * * * *